US009786454B2

(12) United States Patent
Faulkner et al.

(10) Patent No.: US 9,786,454 B2
(45) Date of Patent: Oct. 10, 2017

(54) COMMUTATING SWITCH WITH BLOCKING SEMICONDUCTOR

(71) Applicant: Roger W. Faulkner, Davidson, NC (US)

(72) Inventors: Roger W. Faulkner, Davidson, NC (US); Ronald G. Todd, Framingham, MA (US)

(73) Assignee: Alevo International, S.A., Martigny, Valais (CH)

( * ) Notice: Subject to any disclaimer, the term of this patent is extended or adjusted under 35 U.S.C. 154(b) by 0 days.

(21) Appl. No.: 15/016,437

(22) Filed: Feb. 5, 2016

(65) Prior Publication Data

US 2016/0254109 A1 Sep. 1, 2016

Related U.S. Application Data

(63) Continuation of application No. PCT/US2014/049714, filed on Aug. 5, 2014.

(60) Provisional application No. 61/862,111, filed on Aug. 5, 2013.

(51) Int. Cl.

| | |
|---|---|
| ***H01H 33/59*** | (2006.01) |
| ***H01H 33/16*** | (2006.01) |
| ***H01H 33/22*** | (2006.01) |
| ***H01C 10/50*** | (2006.01) |
| ***H01H 33/68*** | (2006.01) |

(52) U.S. Cl.

CPC ..... *H01H 33/59* (2013.01); *H01C 10/50* (2013.01); *H01H 33/16* (2013.01); *H01H 33/161* (2013.01); *H01H 33/22* (2013.01); *H01H 33/596* (2013.01); *H01H 33/68* (2013.01)

(58) Field of Classification Search

CPC ..... H01H 33/16; H01H 33/161; H01H 33/22; H01H 33/59; H01H 33/596; H01H 33/68

See application file for complete search history.

(56) References Cited

U.S. PATENT DOCUMENTS

| | | | | |
|---|---|---|---|---|
| 4,216,513 | A | 8/1980 | Tokuyama et al. | |
| 5,193,041 | A | 3/1993 | Chanois | |
| 5,218,508 | A | 6/1993 | Doone | |
| 5,339,210 | A * | 8/1994 | Howell | H01H 9/542 361/10 |

(Continued)

FOREIGN PATENT DOCUMENTS

| | | | |
|---|---|---|---|
| EP | 2320535 | A1 | 5/2011 |
| WO | 2011/161121 | A1 | 12/2011 |

(Continued)

OTHER PUBLICATIONS

The International Preliminary Report on Patentability issued on Feb. 18, 2016 for corresponding application No. PCT/US2014/049714.

(Continued)

*Primary Examiner* — Truc Nguyen

(74) *Attorney, Agent, or Firm* — Brian M. Dingman; Dingman IP Law, PC

(57) ABSTRACT

A mechanical switch that works by commutation of the current to an energy absorbing path or sequence of paths through at least one blocking semiconductor to open the circuit, wherein the commutation is caused by a sliding motion of at least one shuttle electrode over at least one stationary electrode.

26 Claims, 6 Drawing Sheets

(56) References Cited

U.S. PATENT DOCUMENTS

| | | | | |
|---|---|---|---|---|
| 5,909,350 | A | 6/1999 | Anthony | |
| 6,128,168 | A * | 10/2000 | Arnold | H01H 9/42 338/21 |
| 6,751,078 | B1 | 6/2004 | Munakata et al. | |
| 7,662,208 | B2 | 2/2010 | Kikuchi et al. | |
| 8,995,097 | B2 | 3/2015 | Skarby | |
| 9,484,168 | B2 * | 11/2016 | Pessina | H01H 33/04 |
| 2002/0070694 | A1 | 6/2002 | Blum | |
| 2007/0197051 | A1 | 8/2007 | Cravey et al. | |
| 2012/0199558 | A1 * | 8/2012 | Faulkner | H01H 33/16 218/143 |
| 2014/0110376 | A1 * | 4/2014 | Zahlmann | H01H 1/2041 218/4 |
| 2017/0018390 | A1 * | 1/2017 | Jaenicke | H01H 9/548 |

FOREIGN PATENT DOCUMENTS

| | | | |
|---|---|---|---|
| WO | 2012/146517 | A1 | 11/2012 |
| WO | 2013/049790 | A1 | 4/2013 |
| WO | 2015/021010 | A1 | 2/2015 |

OTHER PUBLICATIONS

The International Search Report and the Written Opinion of the International Searching Authority issued on Dec. 10, 2014 in Corresponding Application No. PCT/2014/049714.

* cited by examiner

COMMUTATING SWITCH WITH BLOCKING SEMICONDUCTOR

CROSS-REFERENCE TO RELATED APPLICATION

This application is a continuation of and claims priority of PCT Application Number PCT/US14/49714, filed on Aug. 5, 2014, the disclosure of which is incorporated herein by reference. The subject PCT application claimed priority to Provisional Patent Application 61/862,111, filed on Aug. 5, 2013.

FIELD

This disclosure relates to a commutating switch, for example a circuit breaker.

BACKGROUND

In order to open any DC circuit, the inductive energy stored in the magnetic fields due to the flowing current must be absorbed; it can either be stored in capacitors or dissipated in resistors (arcs that form during opening the circuit are in this sense a special case of a resistor). A great difficulty of using ohmic resistors to define the resistance levels for a commutating circuit breaker is that (1) the transient voltage increase for each resistance level depends on current flowing and resistance inserted at the time of the commutation, and (2) the rate of current increase (during the fault) or decay (after resistance insertion) depends mainly on the inductance in a "dead short" which is the most severe kind of fault, in which the system resistance goes to nearly zero; inductance and system resistance (outside the circuit breaker) can vary a lot in real faults. Therefore, it would be ideal to calculate and define the proper resistance levels to insert each time the circuit breaker operates to reach a target maximum transient voltage difference across the inserted resistor, but this is not practical using ohmic resistors.

When varistors, reversed Zener diodes, or transorbs are put into the circuit, they create an opposed electromotive force (EMF) that absorbs stored energy in a fault; this can be viewed as a highly non-linear resistance, but it is also reasonable to view it more like a battery that loses all the energy put into it during charging, but still manages to control the voltage of the "charging current" fairly well.

Because of the rapid inrush of current in a short circuit, the inductive energy can easily be much greater than just the inductive energy stored in the system at normal full load; if the current goes to five times the normal full load amps before being controlled, the inductive energy would be up to twenty-five times as large as in the circuit at normal full load (depending on the location of the short). Until recently, testing standards for DC breakers have assumed slow operation corresponding to arc chute circuit breakers (the standard DC breaker design since the time of Edison), where the time to open the electrodes is typically greater than or equal to three milliseconds (ms) after the trip signal is received; it can take even longer (up to ten ms) to reach the point at which current begins to decrease. This means that high currents can build up in a short circuit through an arc chute breaker, potentially reaching the maximum capability of the DC power source. For this reason, the DC breaker standard applied in the US to circuit breakers for electric trains (ANSI/IEEE 37.20) requires the circuit breaker to be able to handle 200,000 amperes (200 kiloamps, "kA"), about the maximum short circuit current on a DC fault in an electric train subway system.

A second kind of mechanically switched DC circuit breaker includes the innovative, fast acting high speed vacuum circuit breaker (HSVCB) DC circuit breakers from Hitachi (see for example U.S. Pat. No. 4,216,513) which are based on using inductors and capacitors to create an L-C resonant circuit, coupled with an AC vacuum circuit breaker to break the current as it passes through zero. These circuit breakers expose insulation and circuit components of the normally DC circuit to rapid voltage reversal and voltage spikes. A lower maximum current (50 kA) is allowed by the Japanese regulators (standard JEC-7152) for the L-C resonant circuit breakers for use on DC rail applications compared to the 200 kA that must be withstood by the slower arc chute electric rail breakers. This is enabled by the faster circuit opening action of the L-C based resonant breaker. Essentially in such a breaker, a capacitor discharge (which is triggered electronically) sets up an L-C resonant oscillation which causes the current to oscillate through zero, much like an AC circuit. This oscillation decays rapidly, but during the decay, a vacuum circuit breaker opens the circuit as the current crosses zero. A recent U.S. patent applicationb Ser. No. (13/697,204) shows that this mechanism can also be applied to high voltage DC (HVDC) circuits.

The fastest known way to switch off DC power is to use switchable power electronic devices to open the circuit; these are typically semiconductors, either thyristors or transistors, but vacuum tubes can also be used. In these designs, the resistance of the switch per se is an important consideration, as the full circuit load goes through the switch in the on-state. In the case of the most common type of power electronic switches, the integrated gate bipolar transistors (IGBTs), the typical on-state loss would be between 0.25-0.50% of transmitted power, which is unacceptably large for many applications, and also implies a significant cooling load for high power circuits, which typically requires a pumped liquid coolant. The need for active cooling increases cost and environmental impact, and decreases the reliability of the switch.

ABB has been the main developer of another method to speed up operation of DC switches, including circuit breakers, while maintaining lower on-state losses than purely power electronic circuit breakers, which is a hybrid of power electronic and mechanical switches. In this hybrid method, there are at least two power electronic switches combined with a fast mechanical switch. The first power electronic switch is a low-loss, low voltage-withstand switch that commutates the current to a second path through a second power electronic switch with high voltage withstand capability (but higher on-state losses). Said second power electronic switch may be comprised of a stack of IGBT transistors, a stack of gate turn off (GTO) thyristors, or various kinds of tubes which are capable of shutting off the current. Before said second power electronic switch can be turned off electronically, the low voltage withstand first electronic switch must be protected from the resultant voltage surge by a series-connected mechanical switch; the second high voltage capability shutoff switch cannot open the circuit until the moveable electrodes of the mechanical switch reaches the minimum separation to prevent striking or restriking an arc. This series-connected mechanical switch is the slowest component of the switch, so making it faster makes the hybrid switch faster. The currently used fast mechanical switches have electrodes that are magnetically accelerated via electromagnet repulsion or by a capacitor discharge through a Thompson coil (induced magnetic repulsion), and the electrodes separate in a vacuum or in a gas, which could be a sulfur hexafluoride gas or gaseous mixture.

In hybrid breakers for medium voltage DC (MVDC) said first low voltage withstand switch is desirably an IGCT (integrated gate commutated thyristor); for high voltage DC (HVDC) hybrid breakers, said first low voltage withstand switch is desirably a single stage IGBT that commutates the current over to an IGBT array, with many series-connected IGBTs, with each IGBT in parallel with a metal oxide varistor (MOV). The second high voltage capability shutoff switch can comprise a series connected IGBT transistor array, a stack of gate turn off thyristors (GTOs), a cold cathode vacuum tube, or a similar power electronic switch capable of shutting off the power flow.

There is reported to be about a 100 microsecond response delay time in a Thompson coil actuated mechanical switch due to mechanical response of the connected electrode.

If the hybrid switch is also a circuit breaker, there must also be an energy absorbing snubber such as a semiconductor blocking device or a capacitor bank (for example) to absorb the inductive energy stored in the magnetic fields created by the current. The hybrid breaker described above is an example in which most of the stored inductive energy in an HVDC circuit, which can be more than 100 megajoules, is absorbed by a semiconductor blocking device during operation of a circuit breaker.

SUMMARY

This disclosure comprises a mechanical switch that works by commutation of the current to an energy absorbing path or sequence of paths through at least one blocking semiconductor to open the circuit, wherein said commutation is caused by a sliding motion of at least one shuttle electrode over at least one stationary electrode. Said blocking semiconductor can comprise a varistor (such as a polymer-matrix varistor or a metal oxide varistor, "MOV"), a Zener diode (effective for blocking in one direction only, the reverse direction), or a transient voltage suppression diode (bi-directional blocking up to a breakdown voltage). Said blocking semiconductor absorbs at least part of the stored inductive energy to enable circuit opening with controlled maximum voltage (transient voltage suppression diodes are referenced as a "transorb" herein). In order for the sliding switch to not arc upon electrode separation, at least one of these electrodes preferably has a region of increasing resistivity that forms the last part of said electrode to connect electrically to the matching electrode defining the on-state circuit through the switch. In the normal on-state the current passes through the low resistance portion of the matching electrodes, but as the switch opens, current is commutated to at least one well-defined second energy absorbing path through a non-linear, non-ohmic resistor that blocks the current below a threshold breakdown voltage such as a varistor (which could be a polymer-matrix varistor or a metal oxide varistor, "MOV") or a transient voltage suppression diode or a Zener diode; all such voltage-limiting semiconductor devices are referenced as a "blocking semiconductor" herein.

Said variable resistivity trailing edge portion of the electrode can be attached to a shuttle electrode, a stator electrode, or preferably to both. The graded resistivity in the electrode trailing edges prevents formation of an arc upon electrode separation, for an experimentally defined range of fault conditions as to voltage, current, capacitance, and inductance; current and inductance are particularly important, as they determine the amount of stored magnetic energy in the flowing current which must be dissipated or stored to open the circuit.

The switch commutates the current to at least one parallel path through a blocking semiconductor. Using two or more blocking semiconductors can divide the voltage, provide a useful safety margin, or lower the voltage excursion during switching. It is also desirable in some cases that said blocking semiconductor device be integrally connected to a stator electrode over which a shuttle electrode moves, so as to produce a voltage gradient in the stator electrode. The switches of this disclosure are equally applicable to AC or DC power, but have particular advantages for the DC power case.

This disclosure features a commutating switch. The switch may have a stationary portion with a stationary electrode, and a movable portion with a movable electrode. A switch closed position may be defined when the stationary and movable electrodes are in conductive contact, and the movable portion can be moved relative to the stationary portion to break the conductive contact between the stationary and movable electrodes so as to define a switch open position. There may also be a non-linear, non-ohmic blocking semiconductor in an electrical path into which current is commutated as the switch is opened.

The movable portion may comprise a shuttle, or may comprise a rotor. The stationary and movable electrodes may be contained in a dielectric liquid that is at a hydraulic pressure of at least one MPa, and more specifically may be greater than ten MPa. The stationary portion may comprise two stationary, spaced electrodes, and separate electrical paths may be linked through the two stationary, spaced electrodes.

The stationary electrode may comprise a plurality of adjacent separate conductors. As the switch is opened the movable electrode can make electrical contact with one of the separate conductors at a time. Or, as the switch is opened the movable electrode can make electrical contact with at least two of the separate conductors at the same time.

The commutating switch may have a number of non-linear, non-ohmic blocking semiconductors in the electrical path into which current is commutated as the switch is opened. The plurality of non-linear, non-ohmic blocking semiconductors may be arranged in a stack. The non-linear, non-ohmic blocking semiconductors may be metal oxide varistors (MOVs) arranged in a stack in such a way that motion of a commutating electrode moves current through increasing numbers of MOVs, resulting in stepwise increases of voltage across the stack. The MOVs can be arranged so that edges of a foil holding the MOV extend all the way to a zone where direct contact with a moving shuttle electrode occurs, so that the voltage change between neighboring foils is no more than four volts under normal operating conditions.

The stationary portion may be a stator and the movable portion may be a rotor. The rotor may be held stationary in part by friction arising from a tight-fitting stator that is in contact with the rotor over a substantial portion of the surface area of the rotor. The stator may surround the rotor, and the stator may comprise interchangeable keystone-shaped members. The keystone-shaped members may be held against the rotor by an elastic force or an external hydraulic pressure operating on an impermeable membrane that surrounds the keystone-shaped members. The stator may comprise multiple commutation stages, each stage comprising two commutation zones each comprising a conductive lead, multiple stator electrodes that are each electrically coupled to the conductive lead, and a resistor between each stator electrode and the conductive lead, wherein the two conductive leads of the two zones of each stage are electrically connected through a blocking semiconductor. At least some of the stator electrodes may comprise liquid metal.

The electrodes may slide apart. One or both of the stationary and movable electrodes can have a region of graded, increasing resistivity that forms the last part of the electrode that connects electrically with the other electrode when the switch is moved from the closed to the open position.

The commutating switch can include at least two blocking semiconductors in series electrical paths. The stationary portion may comprise a series of stacked metal oxide varistors. The varistors may be annular and of different outside diameters. The movable portion of the switch may be under stress in the closed position. The blocking semiconductor may be selected from the group of semiconductors consisting of a varistor, a Zener diode and a transient voltage suppression diode.

DETAILED DESCRIPTION

Figure 1:
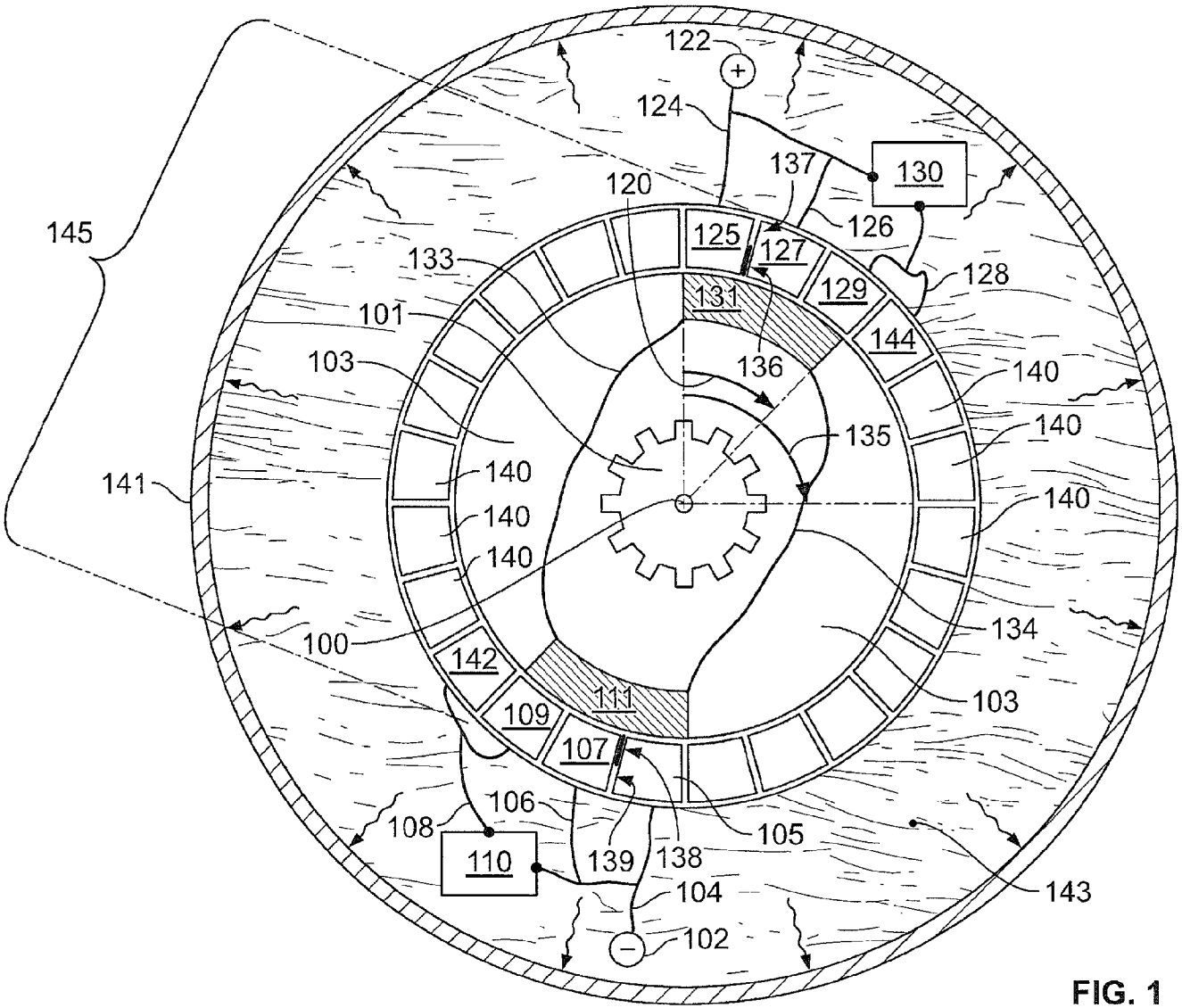
FIG. 1 shows a rotary motion commutating switch with two blocking semiconductors that are linked to stator electrodes that carry the current when the commutator rotates.

This disclosure relates to solid state mechanical switches that are able to open a circuit without generating arcs between the separating electrodes. This disclosure builds on the disclosure of PCT/US2012/058240, the disclosure of which is incorporated in its entirety herein by reference.

The present disclosure comprises blocking semiconductors in place of some or all of the ohmic resistors of the subject PCT application. Such blocking semiconductors include but are not limited to varistors, Zener diodes and transorbs; in all of these current is clamped below a breakdown voltage, defined in terms of a critical current density (0.001 amp per square centimeter, for example). All the blocking semiconductors can be compared in terms of breakdown voltage (voltage where current begins to flow), effective voltage control range (voltage range where the blocking semiconductor usefully controls voltage across its terminals), energy-absorbing capabilities, and life expectancy. A difference between metal oxide-based varistors (MOVs) and transistors such as Zener diodes and transorbs is in the fatigue life. MOVs are degraded every time they are used. They are degraded far more by a large energy pulse than a small one, and keeping track of the state of the MOV can become a maintenance problem. With careful monitoring, MOVs can reliably be re-used, but for designing a low maintenance switch or circuit breaker, transorbs are much preferred technically, though they are more expensive.

Because of the arc-less mechanism of quenching the electrical energy, the switches of this disclosure are particularly advantageous for DC electricity, though they may be used for AC electricity as well. This disclosure also relates to more compact switches because the total electrode displacement to achieve a given level of voltage withstand can be reduced compared to air, vacuum, or gas designs. In the particular case of rotary-motion switches, a high pressure dielectric liquid environment (which inhibits arc formation) can be maintained around the switching mechanism using only a small volume of liquid.

This innovation uses highly non-linear resistors (blocking semiconductors) in the switch such that it is not necessary to commutate over many resistive steps to open the circuit. Prior switches have used varistors, transorbs, or Zener diodes to perform the final circuit opening, but only after absorption of most of the stored inductive energy by an array of ohmic resistors. The present innovation recognizes that it is desirable to absorb a large portion of the stored inductive energy with highly non-linear resistance semiconductor devices such as varistors or transorbs. Prior commutating switches relied on multiple commutations of the current through multiple paths to quench the inductive energy. In the presently disclosed switch a single commutation to a blocking semiconductor can open the circuit. One fundamental advantage of using a blocking semiconductor to do the final circuit opening is that the voltage is nearly constant during the period of absorbing the inductive energy, whereas in order to absorb most of the inductive energy with ohmic resistors requires multiple commutations of resistors into the circuit, after each of which voltage increases, followed by an exponential voltage decay. Aside from the complexity of the mechanism to accomplish the multiple commutations of resistors into the circuit, the repeated exponential decays must have an average voltage below the maximum voltage, which is the key factor for insulation of the switch. Maximum voltage must be limited to control damage done to dielectric components by high voltage transients. Since the inductive energy is quenched as the integral of (voltage) X (current) evaluated over time, maintaining a consistent high voltage near the maximum voltage during quenching (as can be accomplished with blocking semiconductors) can result in faster quenching for the switches of this disclosure compared to other switches. Alternatively, the maximum voltage can be reduced without extending the time to quench the inductive energy.

EXAMPLES

FIG. 1 shows a simple design for a single pole rotary switch (e.g., circuit breaker) of this disclosure. In this case, the rotation of the circuit breaker is driven by a splined shaft 101, which rotates around its axis 100 in the direction of arrow 120. The rotor, which includes 103, 111, 131, 133, and 134 rotates clockwise either by an angle 120 or by an angle 135 during operation of the switch. Component 103 is a dielectric solid with good strength, such as a glass fiber-reinforced polymer or a self-reinforcing polymer such as a liquid crystal polymer; it could also be foimed from a syntactic foam that is cast around the rotor electrodes 111, 131 and the wire electrical connections 133, 134 that link the two rotor electrodes together electrically. Such a syntactic foam is desirable for 103 because of its combination of low density and high stiffness. The entire rotor moves as a rigid body inside a conformal shell formed of 24 keystone shaped segments that each cover an angle of 15 degrees of the conformal shell; the different segments have differing electrical properties: keystones 105, 107, 109, 125, 127, 142 and 144 comprise parts of stator electrodes in that current flows through these segments at times, and 140 is an insulating segment that is used repeatedly for much of the conformal shell (only some of insulating segments 140 are marked in the drawing). An elastic sleeve or fluid pressure may desirably be used to push all the keystone-shaped segments against the rotor.

Electrons move through the switch of FIG. 1 from the relatively negative terminal 102 to the relatively positive terminal 122; electrode segments 105, 107, 109, and 144 are linked to terminal 102 via wire linkages 104, 106, and 108, and electrode segments 125, 127, 129 and 144 are linked to terminal 122 via wire linkages 124, 126, and 128. Electrode segments 107 and 127 are semiconductive in part, but have a layer of insulation proximal to 109 or 129, and may also be graded within themselves in terms of resistivity, so that the resistivity increases from the edge proximal to 105 or 125 to the edge proximal to 109 or 129. Segments 107 and 127 are electrically connected to segments 105 and 125, except for insulated boundary layers 136 and 138, which extend from the inner radius where the stator electrodes meet the rotor electrodes part way up along the boundary between the on-state stator electrodes 105, 125 and the semiconductive stator electrodes 107 and 127. The insulated boundary layers 136 and 138, which extend from the inner radius where the stator electrodes meet the rotor electrodes part way up along the boundary between the on-state stator electrodes 105, 125 and the semiconductive stator electrodes 107, 127 have the function of reducing the highly localized heating that would otherwise occur in semiconductive electrode 107 at the boundary between electrodes 105 and 107 as the trailing edge of rotor electrode 111 passes from 105 to 107, or in semiconductive electrode 127 at the boundary between electrodes 125 and 127 as the trailing edge of rotor electrode 131 passes from 125 to 127. The function of the insulated boundary layers can also be fulfilled by grading the resistivity of the semiconductive electrodes 107 and 127; or even more preferably by also grading the resistivity of the trailing edge of the rotor electrodes 111 and 131. The grading of the electrode trailing edges is thoroughly discussed in the PCT/US2012/058240 application which has been incorporated herein by reference. Outside the insulated boundary layers 136 and 138, there are electrically conductive boundary layers 137, 139, which extend from the outermost radius of the insulated boundary layers 136 and 138 out to the outer edge of the stator electrodes 105 and 107 (for 137), or to the outer edge of stator electrodes 107 and 109 (for 139).

There are two pairs of side-by-side stator electrode segments 109 and 144, and a second pair of stator electrode segments 129 and 144 which are linked through the blocking semiconductors 110 or 130. These side-by-side stator electrode segments are electrically connected via the linking wires 108 and 128 to each other and to the blocking semiconductor 110 or 130. The entire rotary switch is enclosed in a pressure vessel 141 that is filled with high pressure dielectric insulating oil 143. In actuality, the volume of high pressure dielectric oil will generally be much less than is shown in the drawing because the inner edge of the high pressure vessel 141 would desirably nearly mate with the outer edges of the keystones (105, 107, 109, 125, 127, 129, 140, 142 and 144) that form the solid stator which contacts the rotor, so as to minimize the volume of high pressure dielectric fluid. A means (not shown) to hold the keystones against the rotor is also needed, such as a stretched elastomer sleeve or a fluid filled sac (containing fluid at higher pressure than the fluid surrounding the electrodes) that is interposed between the pressure vessel 141 and the outside of the 24 keystone segments making up the stator. In the case that keystone segments are held against the rotor by a fluid filled sac or sacs, the pressure within the sacs can be adjusted to adjust the normal force of the keystone segments against the rotor.

FIG. 1 illustrates several aspects of the disclosure. In this device, power is commutated through two blocking semiconductor devices 110 and 130. Consider for a moment the case that both blocking semiconductors have a breakdown voltage 20% higher than normal line voltage, and the ability to control voltage during a surge to be no higher than 150% normal line voltage. Consider the case that the rotor turns by angle 120, which is 45 degrees. At the end of this displacement, the blocking semiconductors 110, 130 will remain in the circuit. Given this scenario, operation of a DC switch of FIG. 1 in a circuit with enough stored inductive energy to push current through both blocking semiconductors would generate three times the normal line voltage during circuit opening. In this case, the two blocking semiconductor devices remain in the circuit at full shutoff, and the series connection of the two blocking semiconductors creates a failsafe redundancy in which one blocking semiconductor can fail, and the switch will still turn off against a substantial amount of inductive (stored magnetic) energy. Alternatively, the breakdown voltages of these two blocking semiconductors 110, 130 can be selected so that blocking of the current requires both devices in series to block the current; this yields a lower over-voltage on circuit opening (only 1.5 times the normal operating voltage per our assumptions above), but less safety.

At the end of the rotation of the rotor by angle 120, both blocking semiconductor devices are in the circuit. In the case of a high inductance fault, most of the inductive energy that is quenched during opening of the circuit is absorbed by the blocking semiconductors, and a smaller amount by the semiconductive stator electrodes 107, 127. In a low inductance, low current fault, the inductive energy may be mostly or even completely absorbed by the semiconductive stator electrodes 107, 127. It would also be possible for the FIG. 1 device to rotate by angle 135=90 degrees during opening of the switch, in which case the rotor electrodes 111 and 131 would rotate beyond the point (at 60 degrees rotation) where electrical connection through the blocking semiconductors is lost. This provides some safety margin in the case that the blocking semiconductors are MOVs (MOVs are the most economical option). When MOVs fail due to fatigue, a short through the device forms due to repeated overheating of a particular path. For the first few milliseconds of such an MOV electrical fatigue fault, only a small current typically flows, but since this current damages the MOV further, the fault current through the MOV grows rapidly. The device of FIG. 1, with rotation of 90 degrees has a good chance to survive such a MOV failure, because the MOV is taken out of the circuit within a few milliseconds of the triggering of the switch. This is desirable if all the inductive energy can reliably be dissipated during the time that the connections through the blocking semiconductors are in place; otherwise a damaging over-voltage transient can occur when the rotor turns past 60 degrees (for the FIG. 1 design).

Figure 2:
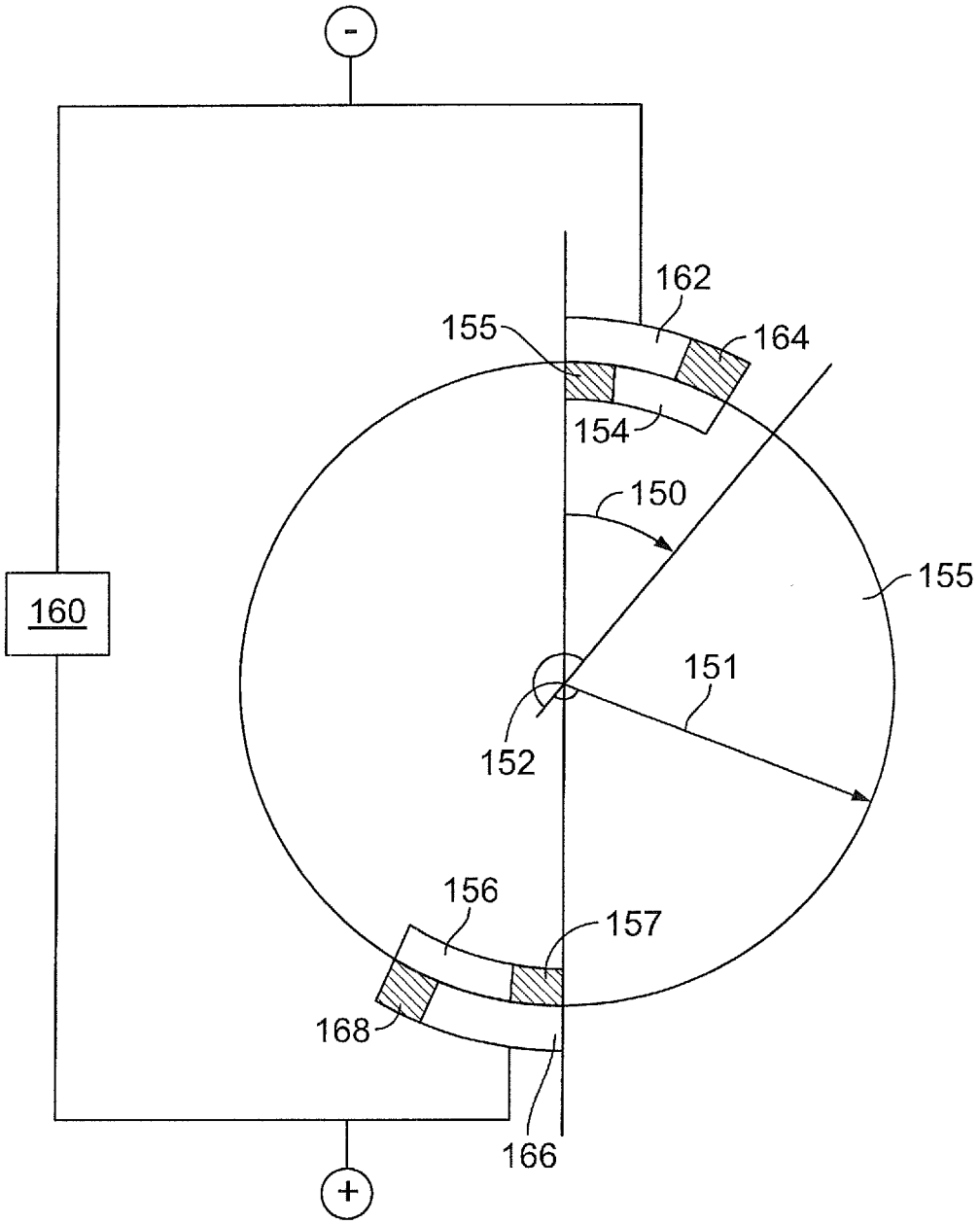
FIG. 2 shows a rotary commutating switch that commutates the current to a single blocking semiconductor to open the circuit.

FIG. 2 is a comparable but simpler version of the single pole switch of FIG. 1. Opening of the circuit is accomplished by clockwise rotation of the rotor 155, which has symmetry axis 152 and radius 151, by angle 150, which is past the angle at which the rotor and stator electrodes lose contact. In this case, the blocking semiconductor 160 is in a parallel circuit with the switch; current is commutated to the blocking semiconductor 160 when rotation of the rotor causes voltage between the two stator electrodes 162 and 166 to exceed the breakdown voltage of the blocking semiconductor 160. The stator electrodes 162 and 166 contact the rotor electrodes 154 and 156 in the on-state, which is shown in FIG. 2. All four of the on-state electrodes (154, 156, 162, 166) are highly conducting, for example copper or silver, or composite structures based on copper or silver, and each one is bonded to a trailing edge electrode (157, 168, 155, or 164) with graded resistivity. As the highly conductive electrodes part, the graded resistivity electrodes continue to carry the current with increasing resistance until most of the current has been commutated to the parallel path through the blocking semiconductor 160. When the graded resistivity electrodes part, the current flowing between them is quite low, less than 0.1 amp, and the voltage is controlled to be in the effective voltage control range of the blocking semiconductor 160. This prevents formation of a substantial arc upon electrode separation, though a small spark may still occur.

Figure 3:
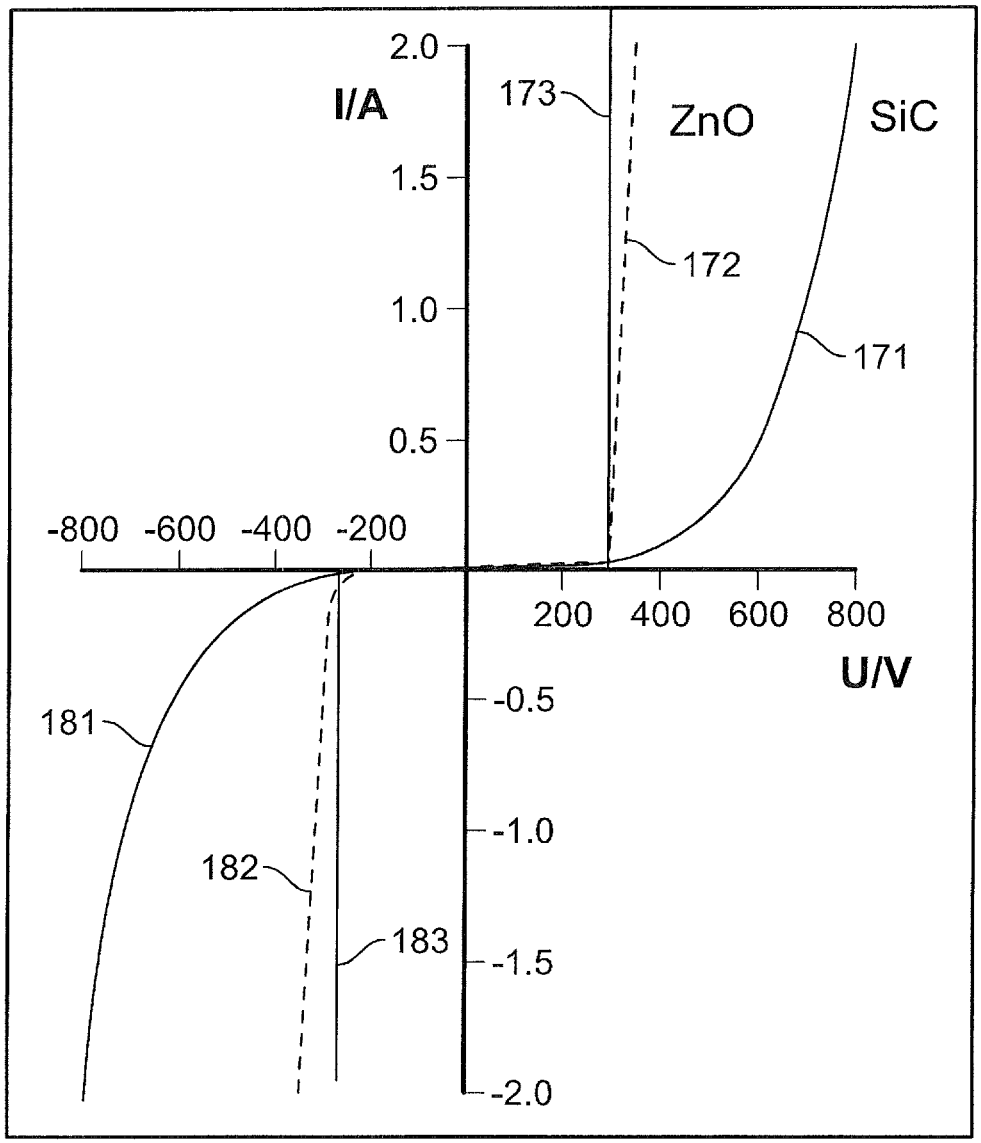
FIG. 3 shows comparative current versus voltage behavior for three types of blocking semiconductors.

FIG. 3 shows the current per square centimeter of two types of MOV on the vertical axis, versus voltage on the horizontal axis. The MOV behavior shown is for a silicon carbide MOV (SiC; 171, 181) and a zinc oxide MOV (ZnO; 172, 182); the approximate behavior of a transorb (173, 183) has been added for comparison as well. The ZnO-based MOV exhibits much more sensitivity to voltage in the region just above the breakdown voltage compared to the SiC-based MOV. A transorb has even higher sensitivity to voltage, and a higher slope in a current versus voltage plot in the region just above the breakdown voltage than a ZnO-based MOV; its current-voltage curve 173, 183 is inside the curve for the ZnO-based MOV 172, 182 in the same way that the ZnO-based MOV is inside the curve of the SiC-based MOV 171, 181 in FIG. 3. A Zener diode would follow the curve of the transorb for negative voltage (183), which is the reverse bias, but would simply conduct current (positive voltage) in the forward direction. Both transorbs and Zener diodes are significantly more expensive than varistors per unit energy absorption capacity. There are scenarios where ZnO-based MOVs, SiC-based MOVs, transorbs, and Zener diodes each make sense in at least some switches of this disclosure.

Figure 4:
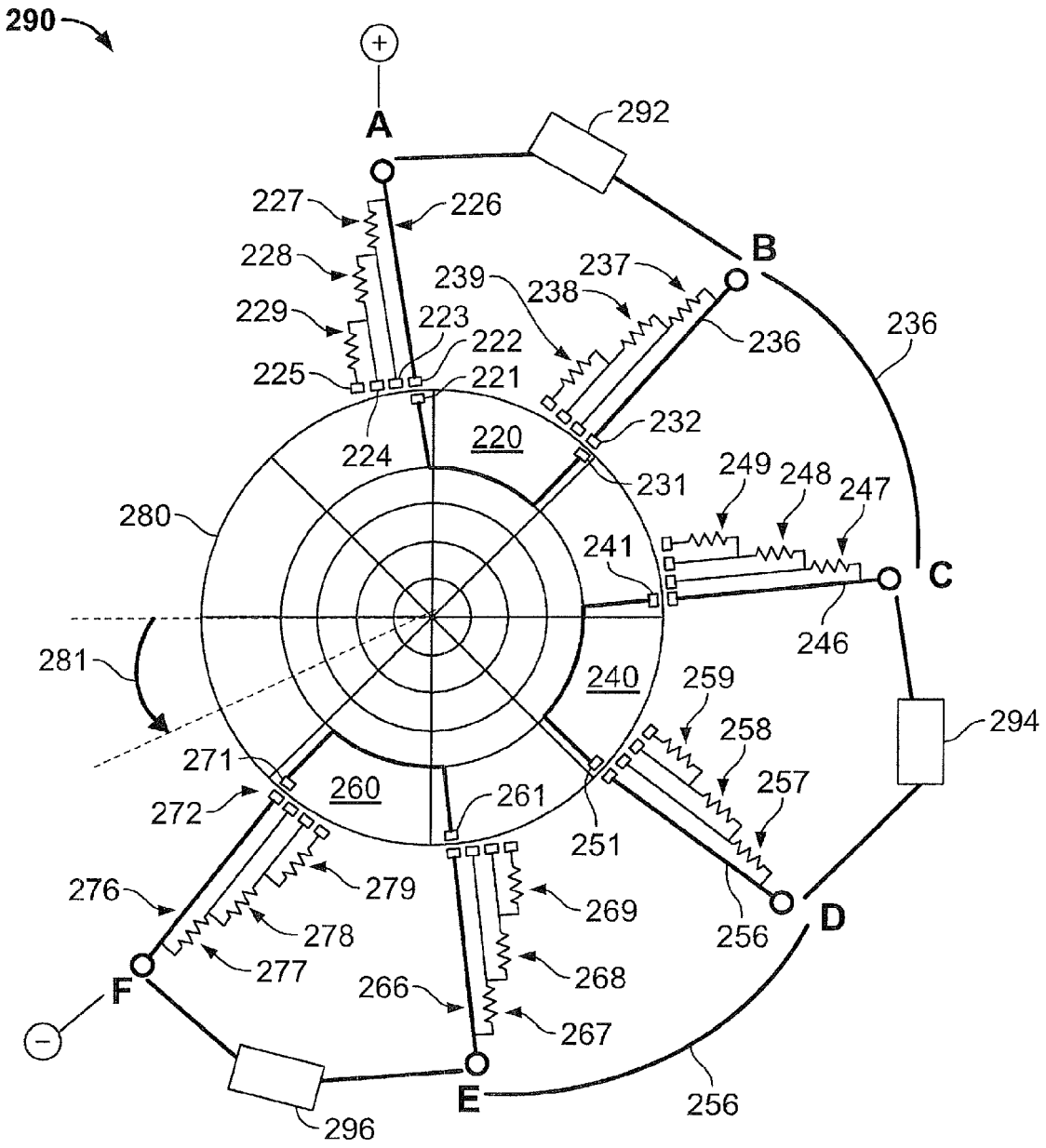
FIG. 4 illustrates a rotary motion multistage commutating circuit breaker with six commutation zones.

FIG. 4 represents a notional rotary multi-stage commutating circuit breaker designed for one pole of a medium to high voltage DC or AC power circuit breaker. In this case, six commutation zones are shown: zone 1 includes elements 221-229 (comprising rotor electrode 221; stator electrodes 222, 223, 224, and 225; conductive lead 226; and resistors 227, 228, and 229); zone 2 includes elements 231-239 (comprising rotor electrode 231; stator electrodes 232, 233, 234, and 235; conductive lead 236; and resistors 237, 238, and 239); zone 3 includes elements 241-249 (comprising rotor electrode 241; stator electrodes 242, 243, 244, and 245; conductive lead 246; and resistors 247, 248, and 249); zone 4 includes elements 251-259 (comprising rotor electrode 251; stator electrodes 252, 253, 254, and 255; conductive lead 256; and resistors 257, 258, and 259); zone 5 includes elements 261-269 (comprising rotor electrode 261; stator electrodes 262, 263, 264, and 265; conductive lead 266; and resistors 267, 268, and 269); and zone 6 includes elements 271-279 (comprising rotor electrode 271; stator electrodes 272, 273, 274, and 275; conductive lead 276; and resistors 277, 278, and 279). These zones are arranged in pairs that comprise commutation stages: the first commutating zone (defined by 221-229 in FIG. 4) is closest to Pole A, and is linked via insulated conductor 220 to the second commutating zone (defined by 231-239 in FIG. 4); this then connects to junction point B through a variable set of resistances depending on how far the rotor 280 has turned. A blocking semiconductor 292 is interposed between Pole A and junction point B; this has the effect of limiting the maximum voltage during opening of the circuit.

The first commutating zone and the second commutating zone together with insulated conductor 220 form the first of three commutation stages in the commutating circuit breaker of FIG. 4. The other two stages include components 240-259 plus blocking semiconductor 294 interposed between junction points C and D, and 260-279 plus blocking semiconductor 296 interposed between junction points E and F. A stage is defined as a complete circuit that moves power on to the commutating rotor and then off of the rotor; in FIG. 4 there are three stages.

The multistage rotary commutating circuit breaker of FIG. 4 is actuated via rotation of the cylindrical commutating rotor 280. The circuit breaker of FIG. 4 has six commutation zones, that commutate power through a series of conventional resistors. Such resistors are less expensive per unit energy dissipation capacity than a blocking semiconductor. The device of FIG. 4 can be economically designed so that 90-95% of inductive energy can be absorbed in the conventional ohmic resistors (this means the MOVs can be smaller and cheaper). This would reduce acquisition, maintenance and operating costs.

In the device of FIG. 4, the commutating rotor takes the form of a rotor that turns about 18.2 degrees counterclockwise to open the circuit, then a further 7.9 degrees to a final open circuit position, so that the total rotation during actuation of the rotary commutating circuit breaker is 26.1 degrees (281). The rotor is composed of strong, electrically insulating materials such as a fiberglass reinforced polymer composite, an engineering grade thermoplastic compound, or a polymer-matrix syntactic foam, except for the rotor electrodes 221, 231, 241, 251, 261, and 271 and the insulated conductive paths shown with heavy black lines (220, 240, and 260) within the rotor that connect pairs of rotor electrodes (such as 221 and 231). The shaft is desirably metallic, but electrically insulated from the conductors 220, 240, and 260. The entire rotating part is surrounded by a stator 290 in which the stator electrodes are mounted. The resistors and also the blocking semiconductors are preferably outside the stator to facilitate heat removal after the circuit breaker trips.

The perspective in FIG. 4 is an end-on view of a commutating rotor which has the shape of a cylinder. The length of the cylinder (perpendicular to the cross-section shown in FIG. 4) can be adjusted to keep the normal full load amps per $cm^2$ of electrode contact area within design limits; thus, depending on the current, the cylinder 280 can look like a disc or a barrel. The circumferential insulated distance between stator electrodes (for example 222, 223, 224, 225) can be adjusted to deal with the voltage gradient at each commutation; in principle, both the width of each stator electrode and the distance between each next neighbor pair of stator electrodes would be adjusted to reach an optimum design. Note that the blocking semiconductors, by limiting the maximum voltage for each stage, also protect against arcing between neighboring stator electrodes. Neither the distances between stator electrodes, nor the width of the stator electrodes, nor the composition of different stator electrodes needs to be the same for any two stator electrodes. Also, multiple series-connected commutating circuit breakers such as that of FIG. 4 can be mounted on a single shaft, to create more commutation stages (6, 9, etc.). In this case, each of the switch contacts 221, 231, 241, 251, 261, and 271;

and their mating contacts 222, etc. only span a fraction of the length of the drive shaft separated by intervening insulating and/or torque drive sections.

In the particular design of FIG. 4, the on-state stator electrodes 222, 232, 242, 252, 262, and 272 are desirably liquid metal electrodes; these are the only stator electrodes which carry high current in the on-state. Liquid metal electrodes are about $10^4$ times as conductive as sliding solid metal electrodes in terms of contact resistance. Liquid metal electrodes can therefore also be narrower than sliding solid contact electrodes, which is a major advantage for the first few commutation steps of a commutating circuit breaker. The liquid metal stator electrodes 222, 232, 242, 252, 262, and 272 can be one tenth as wide as the solid stator electrodes 223, 224, and 225 for example, and still have one thousandth of the contact resistance of the solid stator electrodes. As a particular example, consider the case where the commutating rotor of FIG. 4 is a 31.5 cm diameter barrel-shaped commutating rotor designed for 30 kV DC or AC power. Making one of the liquid metal stator electrodes 222, 232, 242, 252, 262, and 272 one millimeter (mm) wide in the circumferential direction means that it would be possible to achieve the first commutation by only rotating the rotor 280 by 0.36 degrees if the first stator electrode is aligned with the rotor electrode so that there is only one mm to move to cause the first commutation (for example). This first commutation is very important in any circuit breaker in which it is critical to control the maximum fault current, since as soon as the first resistance is inserted the fault current is controlled. Using narrow liquid metal electrodes is one way to speed up the first commutation by reducing the distance that must be moved by the commutating rotor to get to the first commutation.

The six commutation zones of FIG. 4, plus the three blocking semiconductors 292, 294, 296 give this design a high shut-off redundancy and reliability. If failure in one of the three blocking semiconductors is to be survivable as a part of the design, then only two series-connected blocking semiconductors must be able to block the current in a fault. Let's consider (as we have above) the case that the blocking semiconductors are MOVs that have a breakdown voltage 20% higher than normal line voltage, and the ability to control voltage during switching over a voltage control range from 20% to 50% above normal line voltage. This means that three MOVs, each active between 0.60 to 0.75 of normal system voltage, could protect the switch from going above 2.25 times the normal voltage during switching, while still allowing for the failure of one MOV. As more than three stages are deployed, the MOV voltages continue to be reduced, as the voltage is divided between more devices. In an extreme example, all eighteen resistors shown in FIG. 4 could be MOVs with breakthrough voltage 0.0666 times the normal voltage (1.2/18) and maximum voltage in normal operation of 0.0833 times the normal voltage (1.5/18). It is also true that the three blocking semiconductors shown in FIGS. 4: 292, 294, and 296 are each within themselves likely to be series connected stacks of MOVs which are intrinsically more fault tolerant than would be the case with three unitary MOVs.

The trailing edges of the conductive electrodes of FIG. 4 are desirably graded in terms of composition and electrical resistivity to reduce the chance that an arc will initiate at the time the electrodes separate. The outermost surface of the rotor electrodes is best made from a highly conductive metal or composite which is also wear resistant, and which does not oxidize, recrystallize, or interdiffuse with the facing on-state stator electrodes during use. Oxidation can either be prevented by excluding oxygen, or by using an oxidation resistant metal such as gold, platinum, or molybdenum. Where oxygen is excluded, a particulate hard particle/soft metal matrix composite with good electrical conductivity, such as silver- or copper-impregnated porous structures based on sintered metals; for example chromium powder as in U.S. Pat. No. 7,662,208, or tungsten powder, as in commercial electrodes from Mitsubishi Materials C.M.I Co. Ltd. are suitable. Aluminum/silicon carbide electrodes are also suitable in an oxygen-free environment. Where oxygen is not excluded, molybdenum is a favored contact surface for metal electrodes; molybdenum that is plasma sprayed onto aluminum/silicon carbide electrodes is especially favorable.

To achieve a target of losing 1.0 kW to on-state losses at 2000 amps in the closed circuit condition, the total resistance of the path from Pole A to Pole F in FIG. 4 would be at most 2.5E-4 ohms. This low a resistance is likely only feasible with liquid metal on-state electrode junctions, or with large contact area solid metal electrodes. Achieving lower resistance via large contact area entails using a more massive rotor, which requires more torque to accelerate; there exists an optimum design basis on-state resistance target that will be somewhat different for each particular case; in some cases, higher heat production than one kW may be well justified in combination with fan or liquid cooling, which makes it easier to make a working switch without resorting to liquid metal electrodes for the on-state electrode connections.

The spring or other driver used to cause the counterclockwise radial acceleration of FIG. 4 may accelerate the rotor throughout the time of the commutations, or alternatively, a very stiff spring could impart an initial acceleration using up only a small part of the 18.2 degrees of radial motion that the commutating rotor moves during commutation. In this scenario, the commutating rotor is in free flight during most of the time that the switch rotor is moving and causing commutations.

Eighteen ohmic resistance insertions occur during the opening of the circuit of FIG. 4; the resultant voltage, current, and inductive energy changes depend on the initial current at the time of the first commutation and the inductance and resistance of the faulted system. If the exact initial conditions are known, then a large amount of inductive energy can be efficiently absorbed by the ohmic resistors alone of FIG. 4, while keeping the voltage within design limits. This was shown on PCT/US2012/058240, in the discussion of FIG. 6 therein. It is more realistic, however that the initial current at the time of the first commutation and the inductance of the faulted system are unknown, in which case the current could be too high or too low compared to the assumption used to calculate the target resistances of the levels. If the current is too high, the blocking semiconductors 292, 294, 296 will be activated, and will limit the maximum transient voltage created by switching. If the actual current at the first commutation is no more than 100 amps but the assumed value of current at the first commutation is 10 kiloamperes (kA) then the sequence of ohmic resistance insertions of FIG. 4 would be mostly worthless, except for the last few resistance insertions. In such a case, the inductive stored energy is practically irrelevant, and building a switch to be able to handle the stored energy is wasteful. In this case of a low current switch, a simple commutating switch as in FIG. 2, without the parallel blocking semiconductor 160, is a better choice. The design of FIG. 4 is most relevant for high inductance HVDC faults, where there could be from thousands of joules to hundreds of megajoules (MJ) of stored inductive energy to dissipate; using conventional ohmic resistors for absorbing most of the energy can save a lot of money for the many resistors needed to dissipate the short circuit inductive energy compared to what it would cost for MOVs or transistors to absorb all that energy.

A useful modification of the design of FIG. 4 would be to design for only six commutations over conventional resistors before commutating to blocking semiconductors to quench any remaining inductive energy. This allows use of economical conventional ohmic resistors to absorb about 95% of the inductive energy, but simplifies the design by having only two stator electrodes per rotor electrode (that would mean that features 224, 225, 228, 229, 234, 235, 238, 239, 244, 245, 248, 249, 254, 255, 258, 259, 254, 255, 258, 259, 264, 265, 268, 269, 274, 275, 278, 279, would be eliminated from the design). The first six commutations can be timed precisely by adjusting the exact angles of rotation at which each of the first six separations of stator electrode and rotor electrode occur, as the trailing edge of a rotor electrode moves away from the trailing edge of a particular stator electrode. Although FIG. 4 shows the rotor electrodes on the outer radius of the commutating rotor, it is equally possible to put the rotor electrodes on the flat ends of a cylindrical rotor. Both designs have advantages and disadvantages. The design of FIG. 4 is analogous to a drum brake, where the brake pads have an analogous role to that of the stator electrodes, and the drum is analogous to the commutating rotor. The alternative design with the rotor electrodes on the ends of the commutating rotor is analogous to a disc brake.

Figure 5:
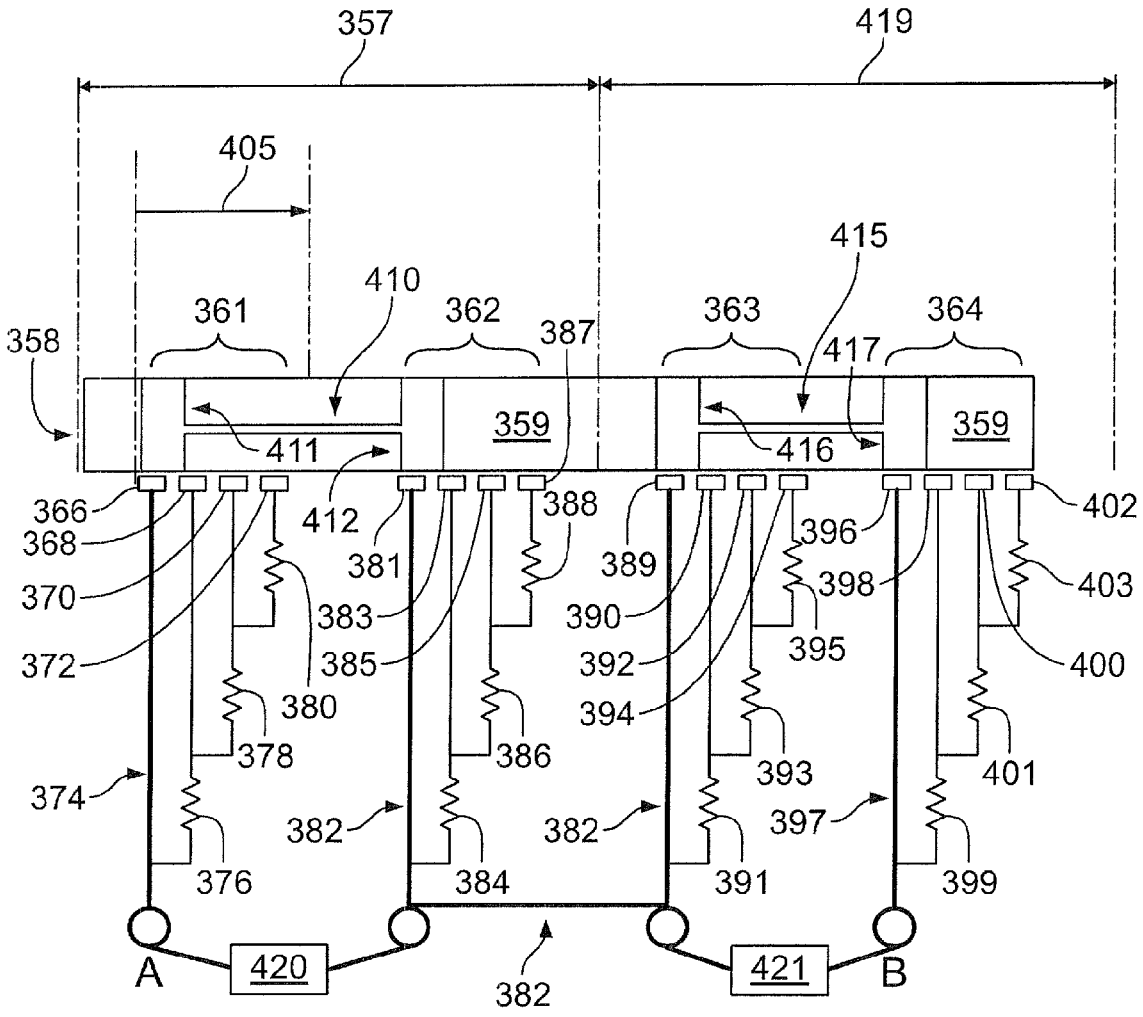
FIG. 5 illustrates a linear motion multistage commutating circuit breaker with four commutation zones in two stages.

FIG. 5 is a two-stage linear motion commutating switch of this disclosure that has a commutating shuttle 358 that moves a distance 405 to open the circuit. The commutating shuttle contains two shuttle electrode pairs comprised of 410, 411, and 412 (shuttle electrode pair #1), and 415, 416, 417 (shuttle electrode pair #2), both of which are embedded in a structural insulator 359. There are four commutation zones 361 to 364: 361 and 362 together form the first stage 357; 363 and 364 together form the second stage 419 of this two-stage commutating circuit breaker. At each stage is a blocking semiconductor: stage 357 has a parallel path through blocking semiconductor 420, and stage 419 has a parallel path through blocking semiconductor 421. In each of these zones there are four stator electrodes; for example commutation zone 361 contains stator electrodes 366, 368, 370, and 372; stator electrode 366 connects through low resistance conductor 374 to Pole A. Stator electrode 368 connects to Pole A through resistor 376; stator electrode 370 connects to Pole A through resistors 378 and 376 in series; stator electrode 372 connects to Pole A through resistors 380, 378, and 376 in series; and similarly for the other commutation zones. Commutation zone 362 contains stator electrodes 381, 383, 385, and 387. Stator electrode 381 connects to stator electrode 389 through low resistance conductor 382. Stator electrode 383 connects to low resistance conductor 382 through resistor 384; stator electrode 385 connects to low resistance conductor 382 through resistors 386 and 384 in series; stator electrode 387 connects to low resistance conductor 382 through resistors 388, 386, and 384 in series. Commutation zone 363 contains stator electrodes 389, 390, 392, and 394. Stator electrode 389 connects to stator electrode 381 through low resistance conductor 382; stator electrode 390 connects to low resistance conductor 382 through resistor 391; stator electrode 392 connects to low resistance conductor 382 through resistors 391 and 393 in series; stator electrode 394 connects to low resistance conductor 382 through resistors 395, 393, and 391 in series. Commutation zone 364 contains stator electrodes 396, 398, 400, and 402. Stator electrode 396 connects to Pole B through low resistance conductor 397. Stator electrode 398 connects to Pole B through resistor 399; stator electrode 400 connects to Pole B through resistors 401 and 399 in series; stator electrode 402 connects to Pole B through resistors 403, 401, and 399 in series.

When the circuit is closed there is a low resistance path from Pole A to Pole B through the commutating circuit breaker in this way: Pole A connects through conductor 374 to stator electrode 366 to shuttle electrode 411, which then connects through insulated conductor 410 to shuttle electrode 412, which then connects to stator electrode 381 and from there through conductor 382. There is also a parallel connection from Pole A to 382 through blocking semiconductor 420; this connection through 420 limits the maximum voltage across stage 357. Conductor 382 delivers the electric current to stator electrode 389, then to shuttle electrode 216, then through insulated conductor 415 to shuttle electrode 417, then to stator electrode 396, then through conductor 397 to Pole B. There is also a parallel connection from 382 to Pole B through blocking semiconductor 421; this connection through 421 limits the maximum voltage across stage 419.

The multiple stage, linear motion switch in this case is essentially a rigid body that maintains a set geometric relationship between the four shuttle electrodes 411, 412, 416, and 417 as it moves to the right to open the circuit. After the twelve resistive insertions implied by FIG. 5, the current is low enough so that the shuttle electrodes can move beyond their last connection through resistors with greatly diminished current which is then cut off by the blocking semiconductors 420 and 421. The presence of the two blocking semiconductors 420 and 421 widens the range of initial conditions to which the switch can adequately respond, as they will also control voltage during the progression through the various ohmic resistor insertions.

A long multistage chain of commutating circuit breakers as in FIG. 5 can be used to break an arbitrarily high voltage. In order to efficiently move a long commutation shuttle such as this implies, it is desirable to use multiple drives along the length of the commutating shuttle, such as multiple springs or gas cylinders positioned to accelerate the shuttle between the commutating zones, or multiple linear motors acting between the commutating zones. A long multistage breaker with embedded permanent magnets can also be driven by known electromagnetic means, for example (however, greater force can be exerted with springs or electromagnets than by coupling to permanent magnets). A combination of drive mechanisms can also be used to achieve greater acceleration than can be produced by one means alone. A variety of triggers and releases can be deployed in such a multistage linear breaker, as is discussed in more detail in PCT/US2012/058240.

It is easier to submerge the cylindrical commutating rotors of FIG. 1, FIG. 2, or FIG. 4 in a pressurized arc suppressing fluid compared to a linear movement commutating circuit breaker such as that of FIG. 5 because rotation of a circularly symmetrical cylinder does not produce form drag, whereas linear motion in a fluid necessarily involves form drag, which can significantly inhibit rapid motion of the commutating shuttle in a liquid, or lead to cavitation which creates voids which are preferred locations for arc initiation. The cylindrical designs also enable a liquid submerged system with a very low volume of liquid compared to a linear actuated design. Sparking can be highly inhibited by fluid surrounding the separating electrodes, especially if the fluid is held at high pressure. Limiting the dielectric fluid to only a few cubic cm is feasible in a cylindrical commutating circuit breaker such as those of FIG. 1, FIG. 2, or FIG. 4, but would be impossible in a linear motion switch of FIG. 5. This means that high dielectric strength fluids such as perfluorocarbon fluids could be economically used in rotary switches of this disclosure. The major advantage of using high pressure liquid dielectrics in a commutating circuit breaker is that the standoff distance between neighboring stator electrodes can be reduced if the gap between the solid dielectrics is flooded with a very high dielectric strength high pressure fluid. This will allow more compact commutating circuit breakers. It has not been practiced commercially in the prior art to operate switchgear at high liquid pressure. The unique shape of the rotary commutating switches of FIG. 1, FIG. 2, or FIG. 4 allows for a very small volume of high pressure liquid, which is not dangerous in terms of stored energy. Hydraulic pressures from ten times atmospheric pressure (1.0 megapascals, MPa) to 200 times atmospheric pressure (20 MPa) are desirable and feasible.

Figure 6:
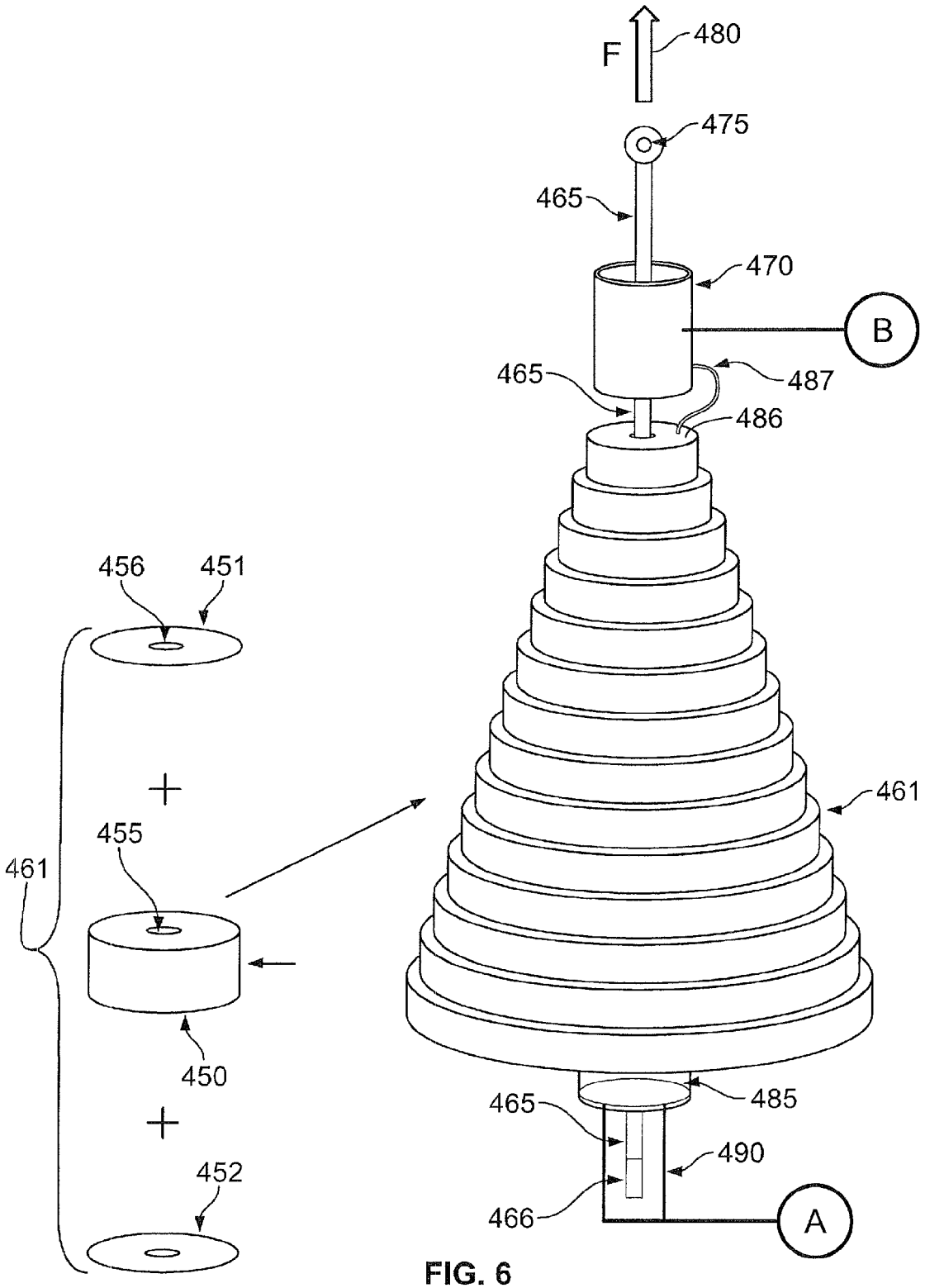
FIG. 6 illustrates a commutating circuit breaker with a shuttle having the shape of a rod, tube, or wire.

MOVs can be conveniently produced as stacks of varistor film on layers of metal foil. The next example shows how stacks of such varistor films can be incorporated into the stator of a commutating switch of this disclosure. FIG. 6 shows a linear motion switch of this disclosure, but such MOV/foil stacks can also be incorporated into the stator of a rotary switch. In FIG. 6, a stack of hollow disc shaped MOV layer assemblies 460 forms the variable resistance portion of this switch. The individual MOV layer assemblies resemble 461 with metal washers 451, 452 on both sides of, and bonded to, a hollow disc MOV core 450. The actual disc shaped MOV layer assemblies such as 450 would be thinner than depicted in FIG. 6 if consisting of only one MOV layer; however, it is normal for the MOV disc such as 450 to itself consist of multiple (printed then fired) MOV layers on metal foil or printed conductive layers. Where a single layer MOV ceramic is painted on to a foil, followed by ceramic processing, the resultant MOV layer would typically be 25-50 microns thick. The breakdown voltage per individual layer is typically 3-3,5 volts, depending on composition, which leads to an average voltage gradient at breakdown along the edge of a stack of MOV/foil layers on the order of around 300 volts/mm. Combining multiple MOV layers into MOV discs as shown in FIG. 6 would result in a voltage change of hundreds of volts per MOV disc. Alternatively, a special assembly composed of 3.5 volt individual MOV layers can be used to form a pyramidal MOV similar to FIG. 6, but with very thin layers, This could have the disadvantage that if faulted, the entire MOV assembly might have to be replaced, rather than a faulted disc-shaped component thereof, such as 461.

Each pair of next neighbor disc MOV layer assemblies (such as 461) is bonded together by some suitable means such as conductive adhesive, soldering, or brazing. The metal washers 451, 452 are very simple examples of stator electrodes, and preferably have a slightly smaller hole 456 through them than the hole 455 through the MOV layers themselves (such as 450), so that the metal washers protrude a little further into the central cavity than the inner radius the MOV elements; in this case it is preferred that a polymer with good electrical withstand, resistivity around 10 to 10^5 ohm-meters, low friction, and good tracking resistance is placed between the inner edges of the metal discs such as 451, 452. This protects the inner surfaces of the actual MOV (such as 450) from damage via direct contact with the moving shuttle electrode 465, which in this case is simply a metal rod or tube that extends clear through the stack of MOV layer assemblies 460. At the bottom end of the shuttle electrode 465 is an optional end 466 of the commutating shuttle 465 which works as an electrical stress control device with a similar function to the trailing edge resistors 155, 164, 157, and 168 of FIG. 2, preventing arcing, but which may also have additional functionality as described below, by providing a gripping surface to hold back the rod-shaped shuttle electrode 465 in the on-state (shown in FIG. 6).

In the on-state, electrical connection to Pole A is made by low resistance stator electrode 490 which can be a high conductivity metal electrode or a liquid metal electrode that mates with the end of shuttle electrode 465. There is a parallel path from Pole A to the bottom of the stack of MOV layer assemblies via electrical contact 485, and then from the upper edge of the MOV stack through connector 486 and conductor 487 to pole B. As the shuttle electrode 465 is withdrawn during operation of the switch, the connection through an increasing length of the MOV stack 460 becomes the only electrical connection between the poles. This parallel path through the MOV stack 460 remains connected before and after operation of the switch as FIG. 6 is drawn. (Alternatively, if 486 and 487 were absent, the MOV connection to Pole B would be cut once the shuttle electrode 465 is withdrawn from the MOV stack.) Connection from Pole B to the commutating shuttle 465 is made through electrical slip ring 470, but other means can also be used. At the upper end of the commutating shuttle 475 is a feature for connecting to a force 480 that pulls the commutating shuttle out of the disc MOV layer assembly stack 460 to open the circuit. FIG. 6 shows the first disc-shaped MOV layer assembly as having the maximum outside diameter, because it is the first disc-shaped MOV layer assembly to be put in the circuit, and usually will see the maximum current for the maximum duration. The cross-sectional areas of the disc-shaped MOV layer assemblies will in general vary proportional to how much energy will be dissipated by an individual disc-shaped MOV layer assembly and so decrease with height within the stack 460.

It is desirable that the lowest disc-shaped MOV layer assembly in FIG. 6 (this is the first one inserted into the circuit) should have the greatest mass and therefore the largest outside diameter. It is important that the metal discs such as 451, 452 cover the entire face of the MOV layer assemblies to which they are attached, so that the current can flow evenly through the entire volume of each disc-shaped MOV layer assembly.

The circuit breaker of FIG. 6 has several unique features. It uses the simplest possible commutating shuttle, a metal rod or tube. The maximum force 480 that can be applied to the rod or tube depends on the strength of the material, and the cross-sectional area of the rod or tube wall. If all the force on the commutating shuttle originates from acceleration, then the maximum acceleration that is possible for any given material is strictly a function of the strength/density ratio of the material forming the commutating shuttle, and the length of the commutating shuttle. If σ is the tensile yield strength of a material in pascals, D is its density in kg/m$^3$, and L is the commutating shuttle length in meters, then the maximum acceleration in meters/second$^2$ $A_{max}$ that can be applied to a commutating shuttle like 465 is given by:

$$A_{max}=\sigma/LD \tag{3}$$

Results from this equation appear in Table 1 for a 2 meter long column of metal pulled from one end as in FIG. 6; maximum feasible acceleration varies from less than 1000 m/s$^2$ for sodium to 114,000 mis$^e$ for aluminum matrix alumina-fiber wire. Table 1 also shows the mass of various materials at 20° C. that are needed to create a 2 meter long 25 micro-ohm column of material; at this loss level the 2 meter long notional commutating shuttle would transmit 2000 amps with 100 watts of $I^2R$ waste heat production. (Waste heat scales linearly with conductor mass, one tenth as much mass conductor means ten times as much heat generation, for example.) The mass of metal required to create a 25 micro-ohm column of material two meters long varies from 3.7 kg of sodium up to 1118 kg for molybdenum.

The best overall solution for a commutating shuttle 465 as in FIG. 6 depends on the relative cost for conductive material versus mechanical structure (including springs and triggers and the structural supports that maintain 465 in a stressed state, or apply stress to it), and critically, on the needed acceleration. The structural cost scales with the mass of conductor that must be accelerated times the acceleration. Acceleration determines time to the critical first commutation, so there is a good reason to push towards high acceleration in order to minimize the time to first commutation, if and where that is important (it is more important to get to the first commutation very fast if the system inductance in a fault is low than if the system inductance in a fault is high). Simply pulling a conductive tube so fast that one comes to the engineering limit for maximum tensile strength of the material (see Table 1 "maximum acceleration" column) is the fastest theoretical way to accelerate a linear motion commutating shuttle.

ger and so is a better solution for commutating shuttle 465. The conductivity of high strength aluminum is also relatively less compromised compared to the pure metal than is the case for magnesium, so high strength aluminum alloy 6061 T-6 is a good choice for commutating shuttle 465. The penultimate column in Table 1 is a dimensionless figure of merit M that ranks the candidate materials for commutating shuttle 465:

$$M=\{(\text{strength})/[\text{density}\times\text{resistivity}]\}/\{(\text{strength})/[\text{density}\times\text{resistivity}]\text{ for annealed copper}\}$$

This figure of merit M is indexed to a reference value for annealed copper of 1.00; higher values of M are more desirable. Of the single component or alloy materials (not composites or fabricated structures) shown in Table 1, cold worked copper has a modestly improved figure of merit M (1.257) compared to copper, and all the forms of magnesium and aluminum examined also have slightly higher M value than annealed copper, ranging from 1.147 to 4.411 for high strength aluminum alloy 6061-T6. The highest figure of merit M in Table 1 (6.424) is for a cermet wire, composed of alumina glass fibers in a matrix of pure aluminum. Such a cermet wire can serve as both conductor and actuator of the motion of the commutating shuttle 465 in FIG. 6.

Because the modulus of the cermet wire (core wire of 3M ACCR) is so high (4550 MPa), stretching it just a few percent can store a large amount of elastic energy (comparable to a very stiff spring) that could supply force 480 while obviating the need for slip ring 470. This design could be used for a very fast actuating design capable to very high voltage. In the most extreme version, it is possible to stress a cermet ACCR wire up to close to its breaking strength (1400 MPa), with the wire strung through an MOV stack such as that shown in FIG. 6, then release the wire below the stack of MOV layer assemblies to open the circuit. This design, in which a high strength fiber reinforced wire 465 extends through a stack of MOV layer assemblies 460, and is restrained below the stack, give a feature 466 that is strongly attached to the stressed wire 465 enables the fastest currently known actuation of a linear motion commutating circuit breaker. There are several known options to rapidly release such a highly stressed fiber-reinforced wire version of 465:

TABLE 1

Data Related to Accelerating a Conductor as in FIG. 6

| Conductor | Density kg/m^3 | tensile yield strength (Pa) | maximum acceleration | resistivity ohm-m | kg to pass 2 kA | movement 4 ms (cm) | Figure of Merit M | max force, pascals |
|---|---|---|---|---|---|---|---|---|
| sodium | 971 | 1.00E+06 | 5.15E+02 | 4.76E−08 | 3.7 | 0.41 | 0.047 | 1.905E+03 |
| calcium | 1550 | 1.11E+07 | 3.56E+03 | 3.36E−08 | 4.2 | 2.85 | 0.456 | 1.485E+04 |
| magnesium | 1738 | 2.00E+07 | 5.75E+03 | 4.39E−08 | 6.1 | 4.60 | 0.564 | 3.512E+04 |
| Magnesium AM60A, B | 1800 | 1.30E+08 | 3.61E+04 | 1.20E−07 | 17 | 28.89 | 1.294 | 6.240E+05 |
| Magnesium AZ91 C, E T6 temper | 1800 | 1.45E+08 | 4.03E+04 | 1.51E−07 | 22 | 32.22 | 1.147 | 8.758E+05 |
| aluminum | 2700 | 5.01E+07 | 9.28E+03 | 2.82E−08 | 6.1 | 7.42 | 1.415 | 5.651E+04 |
| 6061 aluminium alloy, T6 temper | 2700 | 2.21E+08 | 4.09E+04 | 3.99E−08 | 8.6 | 32.74 | 4.411 | 3.527E+05 |
| Aluminum matrix alumina-fiber wire (3M ACCR) | 3294 | 7.50E+08 | 1.14E+05 | 7.62E−08 | 20.1 | 91.07 | 6.424 | 2.286E+06 |
| AlSiC-9 (CPS Technologies) | 3000 | 4.88E+08 | 8.13E+04 | 2.07E−07 | 49.7 | 65.07 | 1.690 | 4.041E+06 |
| copper (annealed) | 8960 | 7.00E+07 | 3.91E+03 | 1.68E−08 | 12.0 | 3.13 | 1.000 | 4.704E+04 |
| copper (cold worked) | 8960 | 2.20E+08 | 1.23E+04 | 4.20E−08 | 30.1 | 9.82 | 1.257 | 3.696E+05 |
| titanium elemental | 4506 | 3.20E+08 | 3.55E+04 | 4.20E−07 | 151 | 28.38 | 0.363 | 5.371E+06 |
| titanium beta-C alloy | 4830 | 1.03E+09 | 1.07E+05 | 1.60E−06 | 618 | 85.41 | 0.287 | 6.602E+07 |
| Tantalum | 16600 | 2.10E+08 | 6.32E+03 | 1.35E−07 | 179 | 5.06 | 0.201 | 1.134E+06 |
| Invar 36 | 8050 | 2.07E+08 | 1.29E+04 | 8.23E−07 | 530 | 10.28 | 0.067 | 6.810E+06 |
| Nichome (20% chromium) | 8400 | 3.54E+08 | 2.10E+04 | 1.30E−06 | 874 | 16.84 | 0.070 | 1.839E+07 |
| molybdenum | 10240 | 4.80E+08 | 2.34E+04 | 1.44E−06 | 1,180 | 18.75 | 0.070 | 2.765E+07 |
| Nickel/Chromium (80/20 Nichrome) | 8400 | 3.45E+08 | 2.05E+04 | 1.25E−06 | 840 | 16.42 | 0.071 | 2.20E+11 |
| Alnico Grade 8 (cast, fully dense) | 7300 | 6.90E+07 | 4.73E+03 | 4.70E−03 | 730 | 3.78 | 0.000 | 2.20E+11 |

The fastest actuation commutating circuit breaker of FIG. 6 using a material from Table 1 would be based on the highest strength/density ratio material, aluminum matrix alumina-fiber wire. This cermet wire is the mechanical strength element (replacing steel in the more standard ASCR aluminum steel core reinforced wire) in 3MTM Aluminum Conductor Composite Reinforced (3M ACCR) wire, which is commercially available from 3M. Using only the list of materials shown in Table 1, a desirable combination of fast actuation combined with a reasonably low total mass to accelerate can also be obtained by making commutating shuttle 465 from a high strength titanium alloy shell with sodium inside. Among the single component potential material solutions for commutating shuttle 465, pure aluminum and pure magnesium have essentially equal mass to meet the 25 micro-ohm resistance target, but pure aluminum is stron- 1. The feature 466 can be a stiff, strong rod that is held in place by a ring of piezoelectric thrusters that hold the wire end 466 in place via a normal force that can be released within 20 microseconds (the needed normal force can be reduced if part of the restraint to motion of 466 can be due to correlated magnetic domains on the surface of 466 that match up with similar domains that are imprinted on the surface of sleeve 490);
2. The wire 465 or a wire end 466 can be cut with high explosives;
3. Fracture of the wire per se or a wire end 466 can be initiated with pulsed lasers.

This type of circuit breaker would be resettable without replacing components only for option 1. The last two methods would still be useful as a form of fast fuse for HVDC circuits that only blow rarely; they too can be reset, however one part (the fuse) needs to be replaced each time. A commutating circuit breaker of FIG. 6 can be reset if piezoelectric grips are used to hold the bottom end of the commutating shuttle 465, through the abutting rod-shaped gripping surface provided by feature 466 in FIG. 6.

The design of FIG. 6 minimizes the mass of non-essential parts of a commutating shuttle, by eliminating most of the insulation attached to the commutating shuttle and minimizing the mass of the trailing edge electric field control technology described elsewhere in this disclosure. Only the conductor is absolutely required for the breaker of FIG. 6; the optional graded resistivity trailing edge component 466 is not a requirement, though it is expected to reduce arcing inside the core of the MOV layer assembly stack during operation, and so is a desirable feature. This design can also be deployed with a high vacuum, or with an arc-quenching gas mixture containing sulfur hexafluoride surrounding the commutating shuttle 465 and the MOV layer assembly stack 460.

All mechanical electrical switches face similar limitations on maximal speed of action. There is always a moveable electrode and the maximum speed of opening the circuit depends on how long it takes for the electrodes to move far enough apart to either quench the arc or other current between the electrodes and prevent restriking an arc. The disclosed switch speeds action of a mechanical switch because the separating electrodes are insulated by high dielectric strength solids and liquids, which can be at high contact or hydraulic pressure to maximize electrical withstand during opening of the electrodes. The absence of gas in the region between the separating electrodes in some versions of the inventive design reduces the electrode separation that is required to prevent restriking an arc; this is true even in the case of a mechanical switch that is opened with no power flowing, but re-energized shortly thereafter, as is normal in various hybrid circuit breaker designs. This allows faster completion of action by the mechanical switch portion of various hybrid switch designs, since the fast mechanical switch of this disclosure does not have to move as far as prior art switches to prevent restriking an arc.

The concepts disclosed herein can be implemented in either rotating or linear motion designs, and preferably utilizes graded resistivity on the trailing edges of electrodes to commutate the power with little or no arcing. Positioning and restraint of stressed shuttle electrodes in the on-state via piezoelectric brakes and correlated magnetic domains, where the shuttle is under stress in the on-state was mentioned in PCT/US2012/058240 and can also be applied to the switches of this disclosure. A further improvement that is added in this disclosure is to use the normal force-mediated frictional force to restrain the motion of the commutating shuttle in the on-state.

The suppression of arcing in the commutating switches of this disclosure relies on three features:

1. Graded resistivity in the parting electrodes;
2. Control of voltage transients during commutation by the blocking semiconductors;
3. Tight clearances between the electrodes and surrounding dielectrics;
4. High pressure liquid dielectrics surrounding the separating electrodes.

One aspect described in PCT/US2012/058240 is to provide a switch primarily insulated by solid dielectrics that fit tightly around the electrodes so as to minimize the size of any fluid-filled cracks that may form between the electrodes during separation; this increases the ability to withstand a given voltage between the electrodes. Note though, that this implies a normal force between the shuttle and stator which is also useful for restraining the force applied to the stator to cause its motion. Such switches by their nature imply significant frictional interaction between the moveable shuttle or rotor electrodes and dielectric solids which are bonded to the moveable electrodes with the surrounding stators, including both stator electrodes and portions of the insulating solid dielectric parts of the stator, which partially constrains motion of the moveable electrodes both before and during switching. Said frictional interaction can be advantageously used in rapid methods of triggering of electrical switches, because the stick-slip nature of the frictional interaction can be used to partially restrain motion of the shuttle electrode prior to triggering. To be specific, static friction is normally greater than kinetic or sliding friction, so a frictionally locked stator in which the critical force to begin motion F(CR) is greater than the actual applied force F(AP) can stably hold its position for a long time, and yet be capable of sustained motion at the same applied force once the motion begins. This makes it possible to trigger motion of the shuttle electrode by providing an extra "kick" of triggering force F(TR) that gets the shuttle moving. After the shuttle is in motion, it will continue to move until the motive applied force F(AP) drops below the critical dynamic force F(DYN). Insofar as the critical force to begin motion F(CR) is proportional to the normal (perpendicular) force between the shuttle and the stator, it is practical to adjust F(CR) by adjusting the pressure around a flexible stator which in turn adjusts the normal force between the shuttle and stator.

Hydraulic cylinders or fluid-filled fiber-reinforced elastomeric bags (similar to high pressure hydraulic hoses) may desirably be used to apply a normal force to the interface between a shuttle and a stator in the switches of this disclosure. This can be visualized by reference to FIG. 1, which shows a large gap between the outside of the modular stator assembly (consisting of keystone-shaped segments 105,107,109, 125, 127, 129, 142, 144, and many copies of 140) and the inside of the pressure vessel 141. In FIG. 1, this zone is filled with dielectric liquid under pressure, but it is easy to imagine that additional features can be added in this zone, such as inflated fabric-reinforced elastomer bags which push the modular stator assembly against the commutating rotor 445 to provide a frictional restraining force that helps to hold the rotor stationary in the on-state.

The modular stator assembly can also be held tightly against the commutating rotor by a stretched elastomeric sleeve that surrounds the outer perimeter of the modular stator assembly.

Although features of the claimed invention are shown in some drawings but not others, this is not a limitation of the scope of the invention. Other examples will occur to those skilled in the field and are within the scope of the claims.

What is claimed is:

1. A commutating switch, comprising:

a stationary portion with a stationary electrode;

a movable portion with a movable electrode;

wherein a switch closed position is defined when the stationary and movable electrodes are in conductive contact;

wherein the movable portion can be moved relative to the stationary portion to break the conductive contact between the stationary and movable electrodes so as to define a switch open position; and a non-linear, non-ohmic blocking semiconductor in an electrical path into which current is commutated as the switch is opened.

2. The commutating switch of claim 1 wherein the movable portion comprises a shuttle.

3. The commutating switch of claim 1 wherein the movable portion comprises a rotor.

4. The commutating switch of claim 3 wherein the stationary and movable electrodes are contained in a dielectric liquid that is at a hydraulic pressure of at least one MPa.

5. The commutating switch of claim 4 wherein the hydraulic pressure is greater than ten MPa.

6. The commutating switch of claim 1 wherein the stationary portion comprises two stationary, spaced electrodes, and wherein separate electrical paths are linked through the two stationary, spaced electrodes.

7. The commutating switch of claim 1 wherein the stationary electrode comprises a plurality of adjacent separate conductors.

8. The commutating switch of claim 7 wherein as the switch is opened the movable electrode makes electrical contact with one of the separate conductors at a time.

9. The commutating switch of claim 7 wherein as the switch is opened the movable electrode makes electrical contact with at least two of the separate conductors at the same time.

10. The commutating switch of claim 1 comprising a plurality of non-linear, non-ohmic blocking semiconductors in the electrical path into which current is commutated as the switch is opened.

11. The commutating switch of claim 10 wherein the plurality of non-linear, non-ohmic blocking semiconductors are arranged in a stack.

12. The commutating switch of claim 11 wherein said non-linear, non-ohmic blocking semiconductors are metal oxide varistors (MOVs) arranged in a stack in such a way that motion of a commutating electrode moves current through increasing numbers of MOVs, resulting in stepwise increases of voltage across the stack.

13. The commutating switch of claim 12 wherein said MOVs are arranged so that edges of a foil holding the MOV extend all the way to a zone where direct contact with a moving shuttle electrode occurs, so that the voltage change between neighboring foils is no more than four volts under normal operating conditions.

14. The commutating switch of claim 1 wherein the stationary portion comprises a stator and the movable portion comprises a rotor.

15. The commutating switch of claim 14 wherein the rotor is held stationary in part by friction arising from a tight-fitting stator that is in contact with the rotor over a substantial portion of the surface area of the rotor.

16. The commutating switch of claim 14 wherein the stator surrounds the rotor, and the stator comprises interchangeable keystone-shaped members.

17. The commutating switch of claim 16 wherein the keystone-shaped members are held against the rotor by an elastic force or an external hydraulic pressure operating on an impermeable membrane that surrounds the keystone-shaped members.

18. The commutating switch of claim 14 wherein the stator comprises multiple commutation stages, each stage comprising two commutation zones each comprising a conductive lead, multiple stator electrodes that are each electrically coupled to the conductive lead, and a resistor between each stator electrode and the conductive lead, wherein the two conductive leads of the two zones of each stage are electrically connected through a blocking semiconductor.

19. The commutating switch of claim 18 wherein at least some of the stator electrodes comprise liquid metal.

20. The commutating switch of claim 1 wherein the electrodes slide apart.

21. The commutating switch of claim 20 wherein the one or both of the stationary and movable electrodes have a region of graded, increasing resistivity that forms the last part of the electrode that connects electrically with the other electrode when the switch is moved from the closed to the open position.

22. The commutating switch of claim 1 comprising at least two blocking semiconductors in series electrical paths.

23. The commutating switch of claim 1 wherein the stationary portion comprises a series of stacked metal oxide varistors.

24. The commutating switch of claim 23 wherein the varistors are annular and of different outside diameters.

25. The commutating switch of claim 1 wherein the movable portion of the switch is under stress in the closed position.

26. The commutating switch of claim 1 wherein the blocking semiconductor is selected from the group of semiconductors consisting of a varistor, a Zener diode and a transient voltage suppression diode.

* * * * *